United States Patent [19]

Giombini

[11] 4,112,517

[45] Sep. 5, 1978

[54] MIXING APPARATUS

[75] Inventor: Giuseppe Giombini, Rome, Italy

[73] Assignee: Colgate-Palmolive Company, New York, N.Y.

[21] Appl. No.: 789,102

[22] Filed: Apr. 20, 1977

Related U.S. Application Data

[63] Continuation of Ser. No. 593,997, Jul. 8, 1975, abandoned, which is a continuation-in-part of Ser. No. 465,760, May 1, 1974, Pat. No. 3,986,706.

[30] Foreign Application Priority Data

May 23, 1973 [IT] Italy ..... 60165 A/73

[51] Int. Cl.[2] ..... B01F 5/26; B01F 13/02

[52] U.S. Cl. ..... 366/102; 366/168; 366/169; 366/171; 366/173; 366/315

[58] Field of Search ..... 366/101, 102, 103, 165, 366/167, 168, 169, 171, 315

[56] References Cited

U.S. PATENT DOCUMENTS

| | | | |
|---|---|---|---|
| 833,790 | 10/1906 | Miles | 366/9 |
| 872,729 | 12/1907 | Hiller | 366/9 |
| 1,369,248 | 2/1921 | Krause | 366/177 |
| 1,406,791 | 2/1922 | Werner | 366/315 |
| 1,658,938 | 2/1928 | Owens | 366/178 |
| 2,581,414 | 1/1952 | Hochberg | 366/138 |
| 2,862,511 | 12/1958 | Forsberg | 366/160 |
| 3,158,358 | 11/1964 | Fischer | 366/171 |
| 3,254,877 | 6/1966 | Goodwin | 366/137 |
| 3,271,194 | 9/1966 | Oikawa | 366/103 |
| 3,389,970 | 6/1968 | Scheibel | 366/169 |
| 3,400,915 | 9/1968 | Onishi | 366/169 |

*Primary Examiner*—Robert W. Jenkins

*Attorney, Agent, or Firm*—Strauch, Nolan, Neale, Nies & Kurz

[57] ABSTRACT

Apparatus for homogeneously mixing relative dry particulate material with liquid material comprising a spinning disc for receiving and forming by centrifugal action a continuous annular free falling curtain layer of particulate material and a lower spinning disc within the curtain layer for forming and centrifugally directing a continuous annular film or spray of liquid material into intersecting relation with the curtain layer.

19 Claims, 6 Drawing Figures

MIXING APPARATUS

RELATED APPLICATION

This application is a continuation of application No. 593,997, filed July 8, 1975, now abandoned; and which is a continuation -in- part of No. 465,760, filed May 1, 1974, now patent No. 3,986,706.

This invention relates to the continuous mixing of particulate materials with liquid and/or other particulate materials, and is particularly concerned with novel apparatus for efficient mixing.

In its preferred embodiment the invention will be disclosed as applied to the homogeneous mixing of relatively dry detergent and like particles with liquids that may be viscous or sticky.

The major advantage of the invention is a apparatus whereby an annular spray or film of liquid is continuously thrown by centrifugal force into a descending annular curtain layer of particulate material for homogeneous mixing therewith.

Another advantage of the invention is a novel mixing apparatus wherein particulate and liquid materials to be mixed are continually supplied to a distributor arrangement from which they are thrown annularly outwardly as respective annular curtain layers and sprays or films that intersect and mix homogeneously. In specific forms, the particulate material and the liquid film or spray may be thrown off the respective upper and lower surfaces of a single spinning disc, or from separate spinning discs driven at the same speed.

PREFERRED EMBODIMENTS

Figure 1:
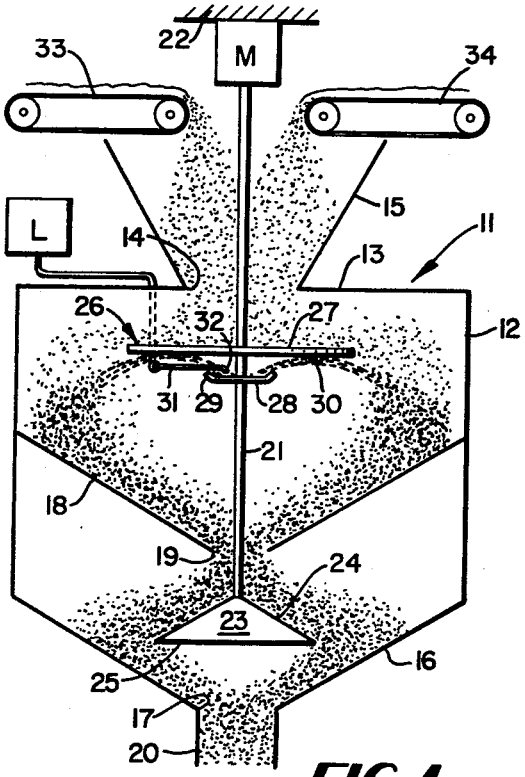
FIG. 1 is a diagrammatic side elevation showing the invention in a preferred embodiment.

Referring to FIG. 1 a mixing apparatus 11 comprises a vertical axis housing having a generally cylindrical side wall 12 and a top wall 13 provided with a circular central inlet opening 14. A conical feed hopper 15 has its smaller end fixed to wall 13 in opening 14. The bottom wall 16 of housing 12 is conical and slopes from the periphery of side wall 12 to a reduced diameter opening circular 17 at the apex. A discharge tube 20 is centered with the axis of the housing and depends from opening 17. Tube 20 may be connected to a packaging assembly.

Within the housing, preferably about halfway down the side of wall 12, an internal fixed conical baffle plate 18 has its larger end fixed to wall 12 and its smaller end formed with a small diameter circular opening 19. The slope of internal baffle wall 18 is preferably about the same as bottom wall 16 so that these walls are substantially parallel.

Preferably all of the housing walls, baffle 18 and the hopper are fabricated of sheet metal and welded together to present internal smooth surfaces. The diameters of openings 17 and 19 may be about equal, and opening 14 is preferably larger than either.

A shaft 21 extends on the axis of the housing from a motor M mounted on a fixed support 22 centrally through openings 14 and 19. Shaft 21 is continuously rotated by the motor, and on the lower end of the shaft 21 a short distance below baffle opening 19 is secured a conical member 23. The side wall 24 of member 23 slopes in the opposite direction from the baffle, that is it slopes downwardly and outwardly to its larger diameter circular base 25 that is perpendicular to the housing axis and disposed about halfway between openings 17 and 19. The diameter of base 25 is preferably much larger than that of both openings 17 and 19 for a purpose to appear. The side wall and base of conical member 23 are preferably sheet metal and welded together, and wall 24 provides a smooth slide surface.

A circular plate disc 26 is fixed on shaft 21 a short distance below inlet opening 14. Disc 26 is appreciably larger in diameter than opening 14 so that all particles entering the housing will first encounter the top surface 27 of disc 26 which is flat smooth and perpendicular to the axis of shaft 21.

A short distance below disc 26 a rotating smaller diameter circular liquid distribution disc 28 is secured to shaft 21. Disc 28 is preferably dish-shaped, having shallow upturned outer rim 29. A liquid supply nozzle 31 extends through an opening in the housing side wall and has a discharge terminal 32 disposed above disc 28. Nozzle 31 is fixed on the housing and its outer end externally of the housing is connected to a source of supply of liquid at L for a purpose to appear. This source may include a conventional type pump and valving mechanism for promoting smooth continuous metered flow of liquid through the nozzle.

Above the open end of hopper 15 are a plurality of particle infeed devices, here disclosed as two endless conveyors 33 and 34 having their discharge ends over hopper 15. Any number of infeed devices for delivering particles to be mixed can be provided. Conveyors 33 and 34 receive the two powders or other particles to be mixed from suitable bin arrangements (not shown) and they are calibrated to continuously deliver correct relative amounts of the dry powders or other particles into hopper 15.

The particles to be mixed fall randomly off the infeed conveyors into hopper 15 where they are guided through opening 14 to fall upon and are uniformly spread over the upper surface 27 of rotating disc 26. Since disc 26 is rotating at a relatively high operative speed the particles are thrown outwardly therefrom by centrifugal force toward the side wall of the housing and start to descend through the housing as an annular relatively thin walled curtain layer after they leave the outer periphery of disc 26. This constitutes a first stage of mixing of the particles.

The descending curtain layer of mixing particles falls on conical baffle 18 and slides inwardly and downwardly to drop through opening 19 onto the rotating conical surface 24. As the particles flow down surface 24 they are thrown outwardly by centrifugal forces which increase as the larger diameter of the cone is reached, and this provides a very effective second stage of mixing of the particles.

After leaving the cone 23, the mixture of particles descends to the bottom wall 16 on which it slides toward the discharge outlet 17 and tube 20 that conveys the mixture to a point of use or further treatment.

In the phase of the invention disclosed in FIG. 1, liquid continually discharged through nozzle 31 enters disc 28 and is thrown upwardly and outwardly as a relatively fine annular spray or film onto the lower flat smooth surface 30 of disc 26 which is perpendicular to the axis of shaft 21. The liquid substantially uniformly covers surface 30 and flows evenly outwardly in all directions in a moving annular film which after leaving disc 26 intersects the descending curtain layer of dry particles thrown off the upper surface of disc 26. The velocity of the liquid film is sufficiently low that the liquid joins the particle curtain with effectively low pressure substantially at the end of its outer trajectory and is not thrown through the curtain. This provides an efficient uniform and thorough mixing of the liquid with the particles in the first mixing stage above baffle 18, and the mixing action is increased during the second stage where the particle-liquid mixture falls on the rotating cone 23.

The foregoing is particularly effective for distributing relatively viscous or sticky liquids homogeneously into relatively dry small particles such as powders or granules. It has been found to be quite efficient in distributing viscous or sticky liquids such as nonionics, phosphoric esters, silicates, oils and perfumes uniformly into dry powder and/or granular mixtures containing spray dried detergent and postadded particulate materials.

In a successfully operating mixing device, the disc 26 is about 30 centimeters in diameter, as is the base 25 of cone 23. Disc 28 is about 15 centimeters in diameter. Since discs 26 and 28 and cone 23 are on the same shaft they are driven at the same operative speed, here about 1200 revolutions per minute. The slope of baffle 18 and bottom wall 16 is about 30° to horizontal, and the slope of conical surface 24 is preferably about 45° to the shaft axis.

It is within the scope of this phase of the invention to provide an annular upwardly discharging nozzle at 31 for supplying liquid directly onto the lower surface of disc 26.

Figure 2:
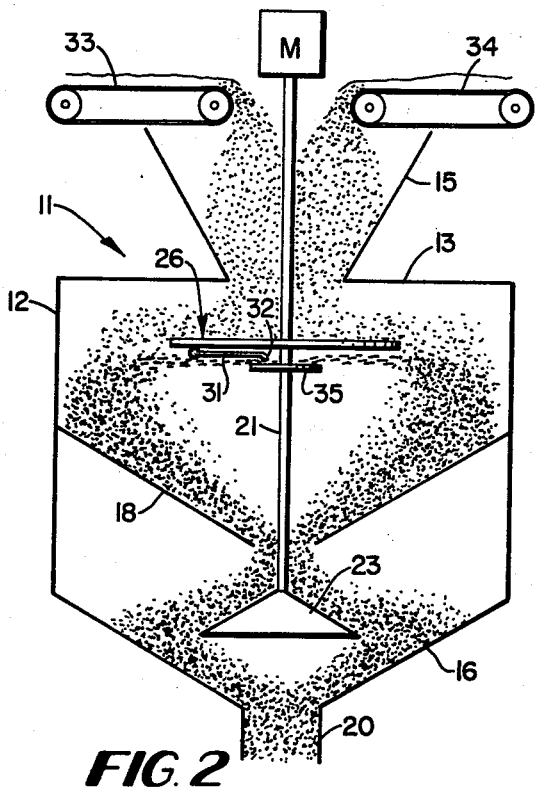
FIG. 2 is a diagrammatic side elevation similar to FIG. 1 but having a different liquid dispersal arrangement.

The apparatus of FIG. 2 differs from FIG. 1 essentially in the mode and arrangement for distributing the liquid to the falling curtain of particulate material. Here nozzle 31 discharges liquid continually onto the top flat surface of a rotating liquid distribution disc 35 on shaft 21 where it spreads uniformly and is thrown out flatly as a thin annular film or spray to join the falling particulate curtain layer and mix homogeneously with the particles. The liquid is not thrown onto the bottom surface of disc 26 in this embodiment, and it preferably directly intersects the particle curtain just below the periphery of disc 26.

Figure 3:
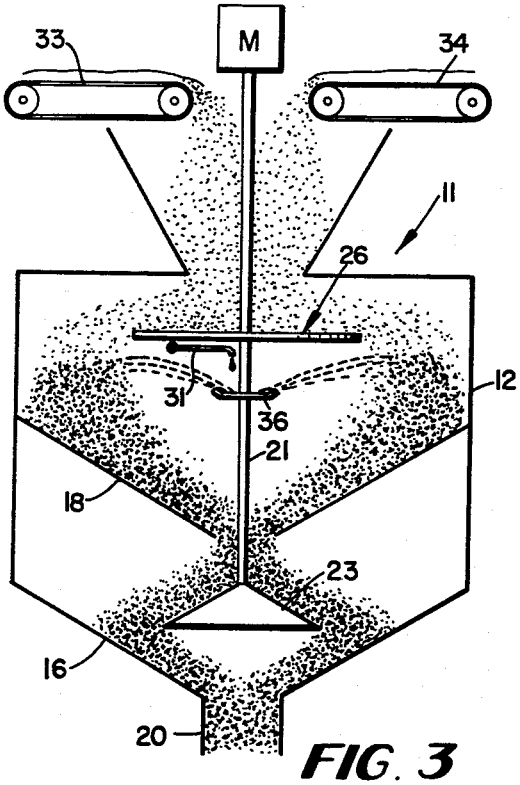
FIG. 3 is another diagrammatic side elevation similar to FIG. 1 and having a further different liquid dispersal arrangement.

The apparatus of FIG. 3 differs from that of FIGS. 1 and 2 in the mode and arrangement for distributing the liquid to the falling curtain of particles. Here nozzle 31 discharges liquid continually into a rotating shallow dish-shaped liquid distribution disc 36 on shaft 21 and is thrown outwardly and upwardly as an annular film or spray to join the falling particulate curtain. The disc 36 is located on shaft 21 further down than discs 28 and 35 to permit the upward dispersal of the liquid over a long path without encountering the bottom of disc 26.

The FIG. 2 and 3 embodiments may be preferable for heavier or more viscous liquids, but the FIG. 1 embodiment is preferable for most efficient dispersal of most liquids.

The apparatus of FIGS. 1–3 may be employed where the liquid is to be mixed with only one particulate material or a partly premixed particulate composition that is deposited into hopper 15. Also more than one nozzle 31 may be provided, as to deposit two separate liquids onto the liquid distribution disc for concurrent mixing with each other and the particles.

Figure 4:
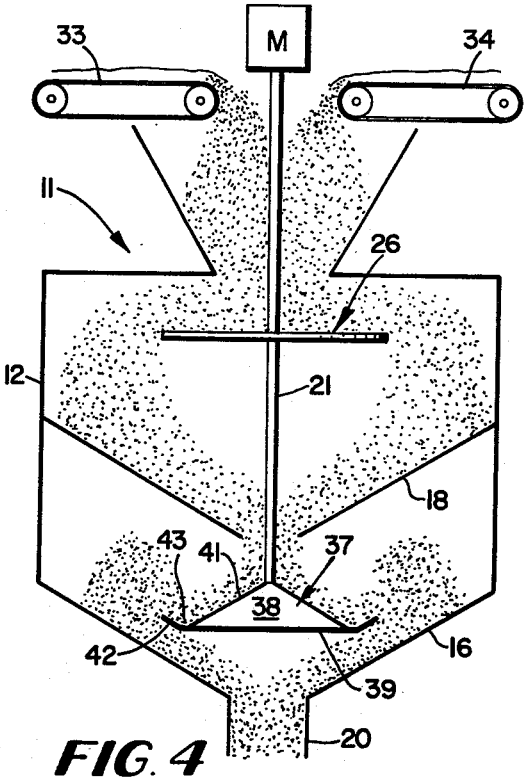
FIG. 4 is a diagrammatic side elevation showing a phase of the invention wherein improved particle mixing is

Referring to FIG. 4 which illustrates a powder mixing apparatus wherein no liquid distribution disc is provided on shaft 21, there is fixed to shaft 21 below the baffle opening a cone 38 having its apex fixed to shaft 21. The cone has a flat base 39 normal to shaft 21. Base 39 extends outwardly of the lower larger end of conical surface 41 and terminates in an upturned rim 42 whereby effectively an annular trough 43 is provided around the base of the cone.

In some forms the disc 26 may be eliminated and the entire centrifugal mixing action accomplished by the cone-trough unit.

In operation the rotating cone 38 provides substantially the same mixing action as cone 23, and this mixing action is increased and improved as some of the powder slides into trough 43 from which it is thrown by centrifugal force outwardly and upwardly toward the housing wall. This arrangement is especially effective for mixing relatively heavy particles or particles that may be slightly damp.

The combination cone-trough distributor 37 of FIG. 4 may be incorporated into any of the FIGS. 1–3 embodiments to increase the overall mixing action.

Figure 5:
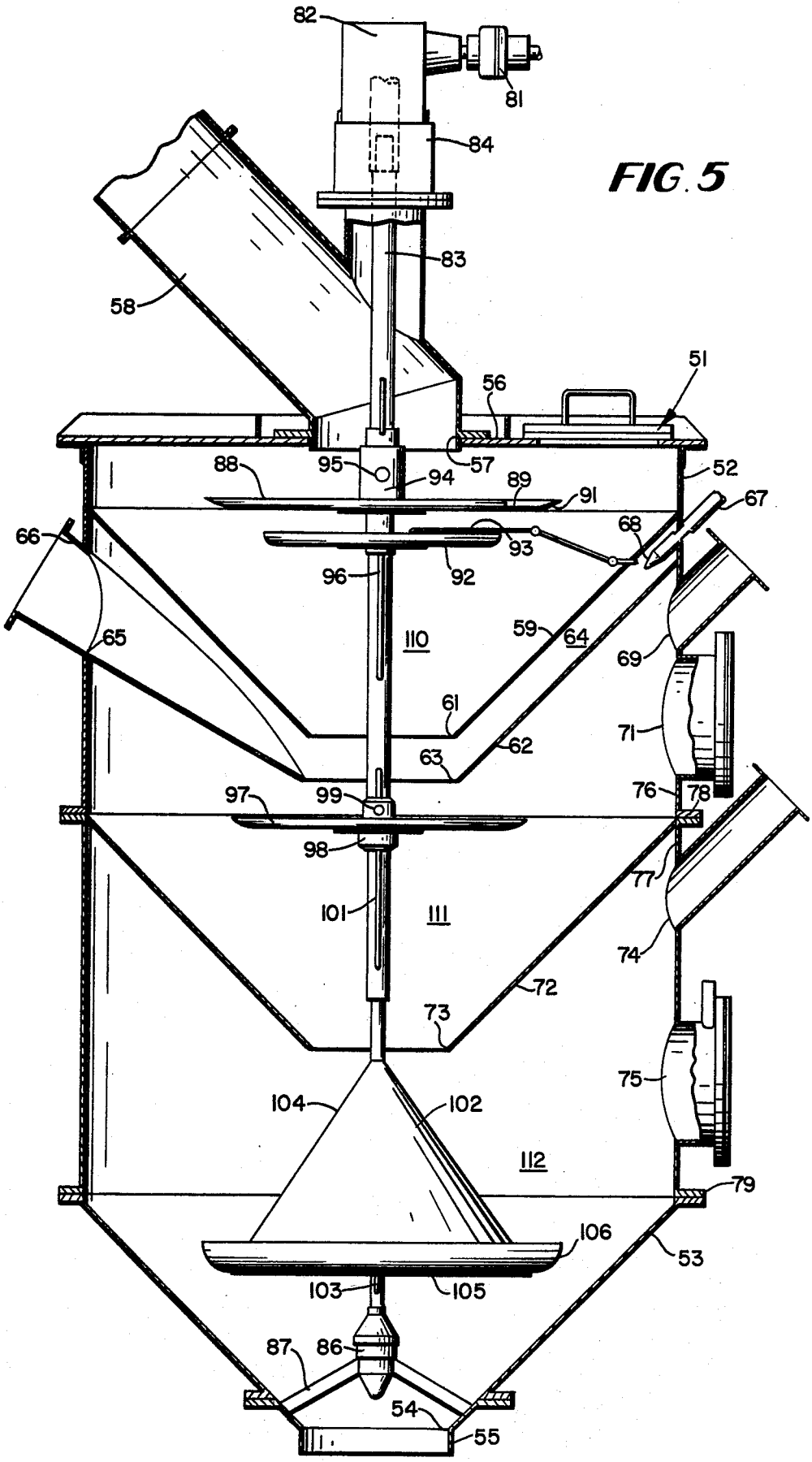
FIG. 5 is a partly diagrammatic side elevation showing a further embodiment similar to FIGS. 1–4 but involving three stages of mixing.

Referring now to FIG. 5, the mixing apparatus comprises a vertical axis housing 51 having a cylindrical side wall 52 and a downwardly inclined conical bottom wall 53 formed with a circular central discharge opening 54 from which depends a discharge tube 55 leading to a packaging equipment conveyor or the like.

The housing top wall 56 has a central opening 57 receiving the lower end of a main material feed tube 58 inclined at about 45° to the housing axis. Tube 58 is connected to a source of main particulate material (not shown) for controlled continuous supply of that material into the housing.

Within the upper part of the housing an internal fixed annular, preferably conical, baffle plate 59 is secured as by welding around its outer periphery to house in wall 52 and slopes downwardly to end in a circular opening 61 coaxial with top wall opening 57. A short distance below baffle 59 a fixed annular generally conical plate 62 that has its outer periphery secured as by welding to housing wall 52 slopes downwardly generally parallel to baffle 59 to end in a circular opening 63 a short distance below and about the same size as opening 61. Baffle 59 and plate 62 define between them a downwardly inclined annular space 64.

At one side of space 64 the housing side wall has an opening 65 for entry of a secondary particulate material feed tube 66. At another point around wall 52 a small diameter tube 67 extends into space 64 and terminates in a nozzle 68 near the upper end of the space. Tube 67 supplies air under pressure for helping distribute the secondary material uniformly around the space 64 as will appear.

Below space 64 the upper part of side wall 52 is provided with normally closed access openings at 69 and 71, for cleanout, inspection or even introduction of other material to be incorporated in this stage.

About halfway down the housing a second internal fixed annular, preferably conical, baffle plate 72 is secured around its outer periphery to housing wall 52 as by welding and slopes downwardly to a circular opening 73 coaxial with openings 61 and 63. Preferably baffle 72 is of about the same size and shape as baffle 59, and openings 61, 63 and 73 are about the same size.

Below baffle 72 the lower part of the housing side wall is formed with normally closed access openings 74 and 75 for cleanout, inspection or even for introduction of further material as may be desired at this stage.

As shown the housing side wall may comprise two separate cylindrical sections 76 and 77 detachably secured together at matched flanges 78, and the bottom wall 53 may be a separate member secured as at matched flanges 79 to the lower end of wall section 77.

Above the mixing housing, a power driven shaft 81 enters a gear box 82 from which extends downwardly a shaft 83 coaxially of openings 57, 61, 73 and 54. Shaft 83 is supported mainly at its upper end within a suitable bearing suspension assembly 84 and extends through a tube 85 to enter material feed tube just above opening 57. The lower end of shaft 83 is mounted in a central bearing assembly 86 supported on chin ribs 87 fixed to the bottom wall. Bearing assembly 86 is mainly for stabilizing the shaft and carries little of its weight, and the ribs 87 do not interfere with discharge of the material. Thus shaft 83 extends on the axis of the housing, and it is rotated at high speed, similarly to shaft 21 of the earlier embodiments.

A circular plate disc 88 is fixed on shaft 83 below opening 57 to receive the main particulate material falling therethrough by gravity. Disc 88 is of appreciably larger diameter than opening 57 and has an upper flat smooth material receiving surface 89 perpendicular to the shaft axis. Disc 88 is essentially the same as disc 26 of the earlier embodiments except that it has an upturned shallow annular outer rim 91 for a purpose to appear. A liquid distribution disc 92 is fixed to shaft 88 a predetermined short distance below disc 88. Disc 92 is preferably dish-shaped like disc 28 of FIG. 1, and it supplied with liquid through a liquid supply nozzle 93 connected to a source similarly to nozzle 31 of FIG. 1.

Preferably both discs 88 and 92 are mounted in fixed axial spacing on a common sleeve 94 that may be axially slidably adjusted along shaft 83, as by a screw 95 and shaft groove 96 arrangement, for properly locating the disc 88 relative to opening 57 and baffle 59, while maintaining the operative spacing between discs 88 and 92. The axial spacing of disc 92 below disc 88 may be such that liquid thrown from it encounters the bottom of disc 88 similarly to FIG. 1, or does not contact disc 18 as in FIG. 3.

About halfway down the housing and below opening 63 a second material distribution disc 97 is fixed on shaft 83, preferably being mounted on a sleeve 98 that may be axially slidably adjusted along the shaft, for setting the proper location of disc relative to opening 63 and baffle 72, by a screw 99 and shaft groove 101 arrangement. Disc 97 is of appreciably larger diameter than opening 63.

A conical member 102 is fixed on the lower end of shaft 88 a short distance below baffle opening 73, and member 102 may be axially adjusted along shaft 88 as by a slidable sleeve (not shown) and a shaft groove 103 arrangement. Member 102 has a downwardly inclined conical surface 104 at the lower end of which the cone base 105 is upturned at 106 to provide a shallow annular trough. The member 102 is thus similar to that at 37 in FIG. 4. The base of cone 102 is appreciably larger in diameter than openings 73 and 54, and the latter opening is at least as large as opening 73.

In operation, the first stage of mixing takes place in the upper part of the housing space indicated at 110. The column of main particulate material falling on rotating disc 88 is thrown outwardly and slightly upwardly toward the housing wall and descends toward baffle 59 as an annular relatively thin-walled curtain layer which before arriving on baffle 59 is intersected by the annular liquid stream thrown outwardly from disc 92. This mixing operation is essentially the same as that in the upper part of the housing in FIG. 1, or FIG. 3, depending on the axial location of disc 92.

The annular layer of material sliding down baffle 59 passes through opening 61 to join the secondary particulate material introduced through space 64, and both pass through opening 63 to descend as a column onto distributor disc 97. More than one entry point for the secondary material may be provided around space 64, and a series of the illustrated air discharge nozzles 68 may be provided to more effectively distribute the secondary material around space 64 and maintain the secondary material in a turbulent condition to prevent caking or other solidification and improve flowability. Desirably an annular stream of the secondary particulate material joins the main material at this point, for uniform mixing.

The advantage of this embodiment is that it enables optimum introduction of a secondary dry particulate material that is incompatible or for various reasons should not be added during the first stage.

As an example, where a perborate or another material such as a flow improving substance is added after spraying of the non-ionic liquid into the main material flowability is improved because wetted mixture particles are coated by the secondary dry material.

The material falling on rotating plate 97 is thrown outwardly toward the housing wall and falls on the baffle 72 as an annular curtain which slides as an annular layer down baffle 72 and onto the conical surface 104 of rotating member 102. Member 102 functions like member 37 of FIG. 4 to centrifugally throw an annular layer of material outwardly to fall on and slide down the inclined bottom wall 53 to be discharged through opening 51.

In the second stage of mixing which takes place in the housing space indicated at 111, the secondary material is uniformly incorporated into the mixture arriving from the first stage, and then in the third stage in the space indicated at 112 the mixture is given a final turbulence, so that optimum mixing is attained before discharge from the housing.

Figure 6:
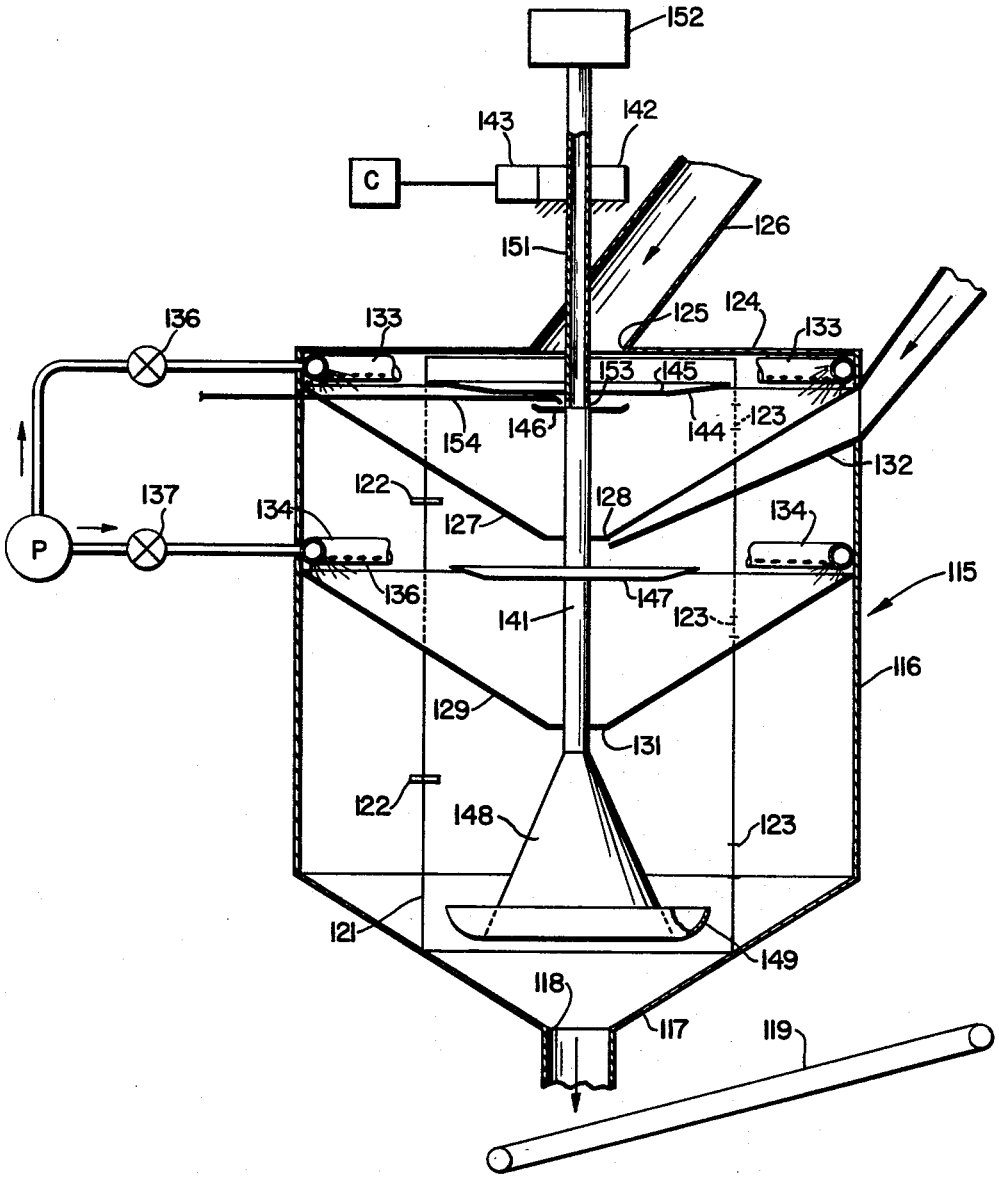
FIG. 6 is a side elevation partly sectioned and partly schematic illustrating a further embodiment.

In FIG. 6 the vertical axis housing 115 has a cylindrical side wall 116 and terminates in an inverted conical bottom wall 117 having a circular discharge opening 118 at its apex for delivering the mixed components to a take-away conveyor 119. As indicated part of side wall 117 may be a door 121 hinged at 122 and latched at 123 when closed. The top wall 124 of the housing is closed except for an inlet 125 connected to a main feed tube 126 for introducing dry particulate material.

A fixed internal conical baffle 127 is secured as by welding around its outer periphery to wall 117 and slopes downwardly to a circular opening 128 on the housing axis. Another fixed internal baffle 129 is similarly peripherally secured to wall 117 and slopes downwardly to a circular opening 131 on the housing axis. The upper surfaces of baffles 127 and 129 and bottom wall 117 are all preferably parallel and inclined at about 55° to the vertical axis of the housing for optimum product flowability.

Below baffle 127 the housing wall is apertured for entry of a secondary particulate material feed tube 132, which corresponds to feed tube 66 in FIG. 5.

An annular conduit 133 is secured to wall 117 adjacent its juncture with top wall 124, and conduit 133 is formed all around its inner periphery with a series of small openings 134. A similar annular conduit 135 is fixed on wall 117 just above the upper edge of baffle 129, and this conduit is likewise provided with a series of small openings 136 all around its inner and lower periphery. Both conduits 133 and 135 are connected to a source of air pressure P whereby a multiplicity of air jets indicated by arrows may discharge into the interior of the mixing apparatus. Valves 137 and 138 control air flow into the respective conduits.

This feature enables compressed air to be discharged at relatively high velocity at regular intervals onto and along the upper surfaces of baffles 127 and 129 which are thereby effectively scoured and cleaned of any of the material mixture that may have collected thereon. This discharge of compressed air also creates an internal turbulence that tends to clean all of the internal exposed surfaces within the housing where material may tend to collect.

The interior of the apparatus may therefore be periodically cleaned without opening the housing and without suspending mixing operations, and it is necessary to open door 121 and clean the housing manually only at widely spaced intervals or when unusual conditions are encountered. Actually the periodic turbulence due to the introduced compressed air tends to augment the mixing action and may be periodically used for that purpose where unusually sticky or heavy materials are being mixed.

A vertical shaft 141 on the housing axis is suspended from above on a suitable support 142 that also mounts a motor 143 and gearing (not shown) connected to rotate the shaft about the vertical axis. Motor 143 is preferably a variable speed motor connected to a control system indicated at C whereby the speed of shaft 141 may be varied to suit mixing requirements. If necessary a lower bearing similar to that at 86 in FIG. 5 may be provided to stabilize shaft 141 during rotation.

Below top opening 125 a dish-shaped particle distribution disc 144 having an upper surface 145 perpendicular to the shaft axis is fixed on shaft 141. Below disc 144 a liquid distribution disc 146 is fixed on shaft 141. Discs 144 and 146 are disposed in axially fixed relation, and may be carried on a common sleeve adjustable along shaft 141 as at 94 in FIG. 5. A distribution disc 147 is fixed on shaft 141 below baffle opening 131, and a conical baffle member 148 having an annular trough 149 around its lower periphery may be secured upon the lower end of shaft 141. Preferably baffle member 148 is removably mounted on shaft 141 so that it can be removed when certain materials such as friable materials are being mixed.

In this embodiment at least the upper end of shaft 141 may be hollow as shown at 151 and connected by a manifold to a source 152 of liquid to be mixed with the particulate material. A plurality of openings 153 in the hollow shaft section distribute the liquid into disc 146. This mode of liquid feed provides a more uniform distribution of liquid and reduces the chances of lump formation of the product. Optionally a liquid infeed conduit 154 like that at 93 in FIG. 5 may supply the liquid to disc 146, or may be used to supply a different or additional liquid so that two liquids that could not be premixed may be simultaneously fed into disc 146.

Operation in the embodiment of FIG. 6 is substantially the same as in FIG. 5, the third stage of mixing below baffle 129 being particularly effective to break up soft lumps of the mixture without impairing the density and particle distribution in the product. This reduces the tailings.

The speed of rotation of shaft 141 and therefore the mixing action may be adapted to the products being worked. For example shaft 141 may be rotated at about 500 r.p.m. where only perfume is added as the liquid; or at about 700–900 r.p.m. for products where large amounts of liquid and powder materials are added after the first stage, for avoiding particle breakage or poor mixing and liquid distribution.

In all embodiments of the invention mixing takes place mainly in a vortex internally of the housing and defined by the baffles and other wall surfaces within the housing.

Preferably all internal surfaces of the mixer that are contacted by the particles, liquid or the mixture thereof are coated with a hard smooth slippery inert plastic such as teflon which inhibits sticking of powder or liquid to those surfaces.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. Apparatus for homogeneously mixing relatively dry particulate material with liquid material comprising a distributor member rotatable about a vertical axis, means for feeding dry particulate material directly onto said distributor member for centrifugal distribution therefrom whereby there is formed below said distributor member a continuous annular free falling curtain layer of said particulate material, means below said distributor member within said curtain layer for forming and directing a separate continuous annular film or spray of liquid material into direct intersecting relation with said falling curtain layer in an annular region spaced outwardly beyond and below the periphery of said distributor member, further distributor means rotatable about said axis and located below said liquid film forming means to receive and centrifugally distribute the mixed particulate and liquid materials, means above said further distributor means for collecting said falling curtain and the admixed liquid materials and directing the same to said further distributor means, and means for collecting and discharging the centrifugally distributed material from said further distributor means.

2. The apparatus defined in claim 1, wherein means is provided between said collecting means and said further distributor means for introducing a second particulate material into the mixture of the first said particulate and liquid materials.

3. Apparatus as defined in claim 1, wherein said distributor member is plate-like with a mainly flat top surface to which said particulate material is continuously supplied 4. Apparatus as defined in claim 3, wherein said distributor member is a disc having a shallow upturned rim around its outer periphery.

5. Apparatus as defined in claim 3, said film or spray forming means comprising means directing a continuous supply of said liquid material onto the bottom surface of said distributor member.

6. Apparatus as defined in claim 5, wherein said distributor member is a disc having flat top and bottom surfaces normal to the axis of rotation of the disc.

7. Apparatus as defined in claim 3, wherein said dry particulate distributor member is fixed on a power driven rotatable vertical shaft, and said film or spray forming means is a liquid distributor member secured on the shaft in axially spaced relation below said particulate distributor member and includes means for supplying liquid directly to said liquid distributor member.

8. Apparatus as defined in claim 7, wherein said liquid supply means comprises a conduit connected to continuously receive liquid from a source and terminating in nozzle means positioned above said liquid distributor member.

9. Apparatus as defined in claim 7, wherein said liquid supply means comprises a hollow section of said shaft connected to continuously receive liquid from a source and having a plurality of openings through which liquid is discharged onto said liquid distributor member.

10. Apparatus as defined in claim 1, wherein said liquid film or spray forming means is a member rotatable about said axis and located a predetermined distance below said distributor member, and said collecting means comprises a fixed annular downwardly converging baffle below and coaxial with said member for receiving the descending layer and guiding it to an opening centrally of said baffle above said further distributor means.

11. Apparatus as defined in claim 10, wherein means is provided for introducing a second particulate material into the mixture below said baffle opening, said further distributor means comprises a second distributor member rotatable about said vertical axis below said baffle opening to receive the mixed first, second and liquid materials for centrifugally distributing that mixture outwardly to provide a second descending annular layer, a second fixed annular downwardly converging baffle mounted within the housing to receive and guide said second layer to an opening centrally of said second baffle, and a rotating coaxial conical surface mounted below said baffle opening in the path of the mixture flowing through said second baffle opening.

12. Apparatus as defined in claim 10 wherein means is provided for introducing gas under pressure into said housing and directing it mainly toward the upper surfaces of said baffle.

13. Apparatus as defined in claim 12, wherein said gas introducing means comprises a torodial conduit fixed on the housing side wall and formed with a series of discharge openings, and means is provided for connecting said conduit to a source of compressed air.

14. Apparatus as defined in claim 1, comprising a housing having an upper opening through which particulate material is introduced onto the upper surface of said distributor member, a generally vertical power driven shaft extending into said housing with said particle distribution member being fixed on said shaft within the housing, and said liquid film or spray forming means comprising a liquid distribution member fixed on said shaft below said particle distribution member and means for supplying liquid thereto.

15. Apparatus as defined in claim 14, wherein said housing has an internal conical baffle below said particle and liquid distribution members sloping downwardly and inwardly to an opening centrally of the housing to provide said collecting means, and said further distributor means comprises a conical downwardly diverging surface fixed at its apex on the lower end of said shaft.

16. Apparatus as defined in claim 15, wherein means is provided for introducing a second particulate material into the mixture passed through said baffle opening, said further distributor means comprises a second particle distribution member fixed on said shaft to receive and centrifugally distribute the mixture of said first, second and liquid materials, and a second internal conical baffle is fixed in the housing to receive material thrown outwardly from said second particle distributor member and guide it to a central fixed opening disposed above said conical surface.

17. Apparatus as defined in claim 1, wherein said distributor member is a first plate-like member fixed on a rotatable vertical shaft, said means for forming and directing said annular film or spray of liquid is a second plate-like member fixed on said shaft a predetermined distance below said first member, a downwardly sloping fixed annular surface is positioned to receive the mixed particulate and liquid materials and discharge through a central opening, siad further distributor means comprises a third plate-like member fixed on said shaft below said opening, and a downwardly diverging material spreading cone is fixed on the lower end of said shaft, and a second downwardly sloping fixed annular surface is positioned below said third plate-like member with a central discharge opening above said cone.

13. Apparatus as defined in claim 17, wherein said first and second plate-like members are mounted on a common sleeve adjustable along said shaft.

19. Apparatus as defined in claim 17, wherein a shallow trough is formed around the lower base end of said cone.

* * * * *

UNITED STATES PATENT OFFICE

CERTIFICATE OF CORRECTION

Patent No. 4,112,517 Dated September 5, 1978

Inventor(s) Giuseppe Giombini

It is certified that error appears in the above-identified patent and that said Letters Patent are hereby corrected as shown below:

Column 1, line 44, after "is" insert --attained;--.

Column 4, line 13, after "opening" insert --19 a novel particle distributor 37 consisting essentially of--.

Column 4, line 47, delete "house in" and insert --housing--.

Column 5, line 24, change "chin" to --thin--.

Column 9, line 4 (claim 3), after "supplied" insert --.--.

Column 10, line 45, change "siad" to --said--.

Signed and Sealed this

Tenth Day of April 1979

[SEAL]

Attest:

RUTH C. MASON
Attesting Officer

DONALD W. BANNER
Commissioner of Patents and Trademarks